US008944132B1

(12) United States Patent
Floyd

(10) Patent No.: US 8,944,132 B1
(45) Date of Patent: Feb. 3, 2015

(54) RETRACTABLE PRIVACY SCREEN AND MOUNTING FIXTURE

(76) Inventor: Kevin Floyd, High Ridge, MO (US)

( * ) Notice: Subject to any disclaimer, the term of this patent is extended or adjusted under 35 U.S.C. 154(b) by 252 days.

(21) Appl. No.: 13/561,878

(22) Filed: Jul. 30, 2012

Related U.S. Application Data

(60) Provisional application No. 61/522,029, filed on Aug. 10, 2011.

(51) Int. Cl.
*E04F 10/06* (2006.01)
*A47G 5/02* (2006.01)
*E06B 9/40* (2006.01)

(52) U.S. Cl.
CPC .... *A47G 5/02* (2013.01); *E06B 9/40* (2013.01)
USPC ..... 160/66; 160/23.1; 160/370.22

(58) Field of Classification Search
CPC ..... A47G 5/02; A47B 83/001; E04B 2/7422; E04B 2/827
USPC ..... 160/23.1, 24, 66, 370.22
See application file for complete search history.

(56) References Cited

U.S. PATENT DOCUMENTS

| | | | | |
|---|---|---|---|---|
| 2,506,209 | A * | 5/1950 | Glass | 40/514 |
| 5,287,909 | A * | 2/1994 | King et al. | 160/135 |
| 6,115,951 | A * | 9/2000 | Jing et al. | 40/610 |
| 6,191,886 | B1 * | 2/2001 | Sinkoff | 359/443 |
| 6,503,188 | B1 * | 1/2003 | August | 600/27 |
| 8,561,355 | B2 * | 10/2013 | Canavarro | 52/36.1 |
| 2004/0250480 | A1 * | 12/2004 | Matthai | 52/36.1 |
| 2008/0134601 | A1 * | 6/2008 | Cruz | 52/236.2 |
| 2008/0211361 | A1 * | 9/2008 | Boxenbaum et al. | 312/196 |
| 2009/0078379 | A1 * | 3/2009 | Hansen | 160/265 |

* cited by examiner

*Primary Examiner* — Katherine Mitchell
*Assistant Examiner* — Abe Massad
(74) *Attorney, Agent, or Firm* — CreatiVenture Law; Linda L. Lewis

(57) ABSTRACT

A mounting fixture that can be mounted horizontally, with a retractable privacy screen on a spring mounted roller, wherein the fixture comprises a first surface and a second surface, wherein the first surface and the second surface are movingly engaged to open and close, wherein the roller is attached to the first surface, wherein the screen has an extended upward position and a retracted downward position wherein an extension member is attached to the shade and the first surface so that when the member is extended the screen is moved vertically to the extended upward position, and when the member is retracted, the screen is moved to the retracted downward position. The spring loaded roller keeps tension on the screen which prevents the extended screen from being unstable or floppy.

16 Claims, 3 Drawing Sheets

RETRACTABLE PRIVACY SCREEN AND MOUNTING FIXTURE

CROSS-REFERENCE TO RELATED APPLICATIONS

This application claims priority from U.S. Provisional Patent Application No. 61/522,029 filed Aug. 10, 2011.

BACKGROUND OF THE INVENTION

1. Field of the Invention

The present invention relates to a vertically retractable privacy screen mounted inside a fixture, wherein the fixture can be mounted horizontally on the top of office cubicle walls and other structures.

2. Related Art

Offices that use cubicles to define office space often lack privacy or shielding from sunlight or excessive noise. Devices have been disclosed to increase privacy, such as the privacy screen disclosed by U.S. Pat. No. 5,287,909 which discloses a horizontally retractable privacy screen used as a cubicle door. The screen is not mounted on top of a cubicle wall and is not vertically extendable and retractable.

Retractable screens have been disclosed for use in business or classrooms that mount on a wall and are pulled down to use as a projector screen. Such screens are not suitable for mounting on top of an office cubicle wall to extend upward as a privacy screen. Portable, free-standing projector screens have a base typically with legs and a telescoping arm to hold the screen upright. Such screens are not suitable for mounting on the top of a cubicle wall, nor do they provide an enclosure for the screen when it is retracted for neat, attractive storage. The arm of a portable projector screen cannot be stored by allowing the arm to be lowered into the wall, conveniently concealed for storage, and readily available to use for a privacy screen for future use.

SUMMARY OF THE INVENTION

The present invention is a mounting fixture with a retractable privacy screen on a spring loaded roller, wherein the fixture comprises a first surface and a second surface, wherein the first surface and the second surface are movingly engaged to open and close. In the closed position the first and second surfaces approximately enclose the roller containing the retractable screen, where the spring loaded roller is attached to the first surface, wherein the screen has an extended upward position and a retracted downward position. An extension member is attached to the shade and the first surface so that when the member is extended the screen is moved vertically to the extended upward position and held there, and when the member is retracted, the screen is moved to the retracted downward position. The spring loaded roller keeps tension on the screen which prevents the extended screen from being unstable or floppy. The fixture can be mounted horizontally, such as along the top of a cubicle wall. This wall is typically formed by two panels held in parallel alignment forming a space between the panels and covered by the top of the wall. When the screen is extended it is held up by the extension member. When the screen is retracted the extension member can extend moveably downward through an opening in the first surface aligned with an opening in the top of the cubicle wall. The extension member is moved downward into the cubicle wall where it is concealed in the space between the two wall panels. After retraction, and when the fixture is in the closed position, the screen, roller and extension member are all neatly stored out of sight.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
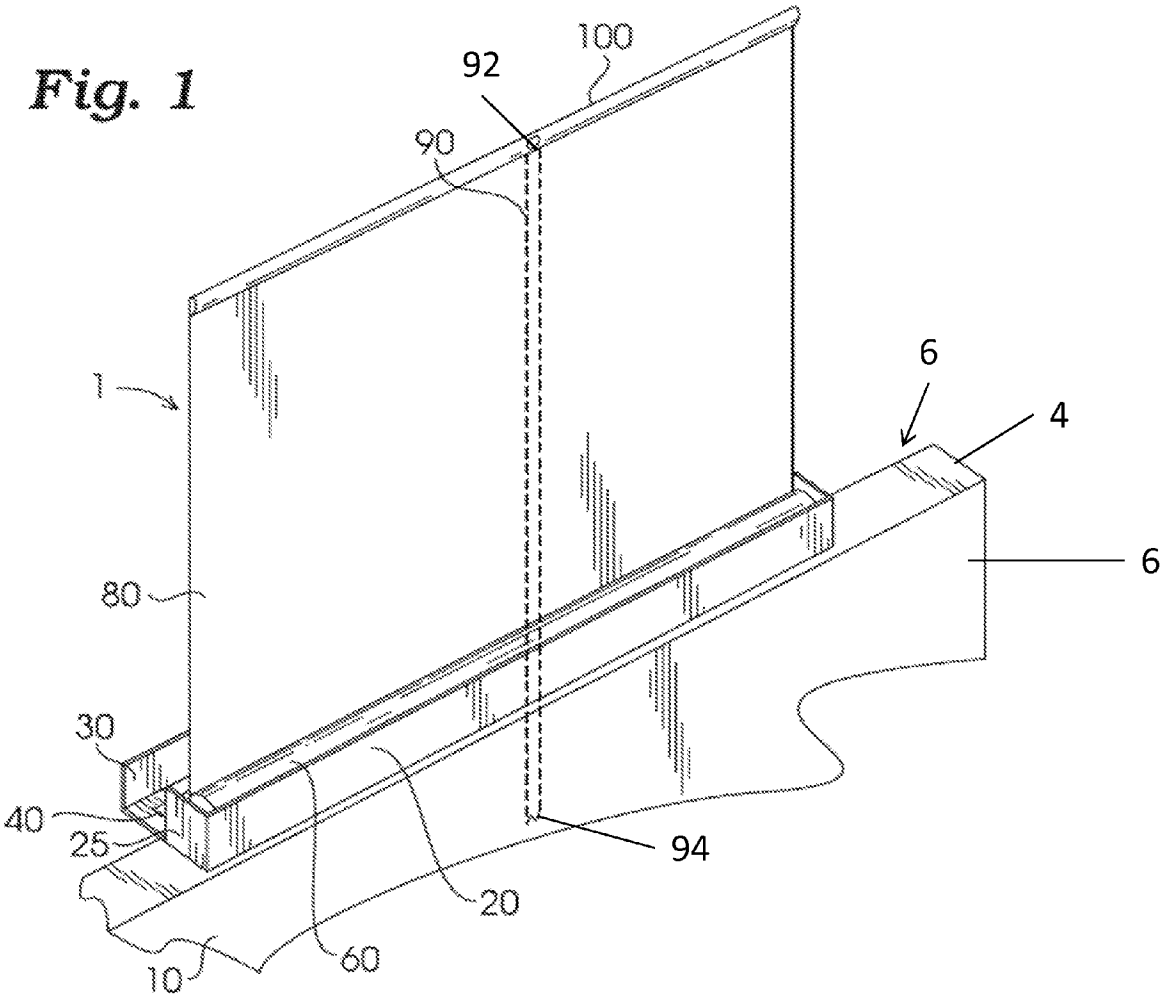
FIG. 1 is a front perspective drawing of the mounting fixture with the first and second surfaces in the open position and the screen in the extended upward position with the extension member extended.
Figure 2:
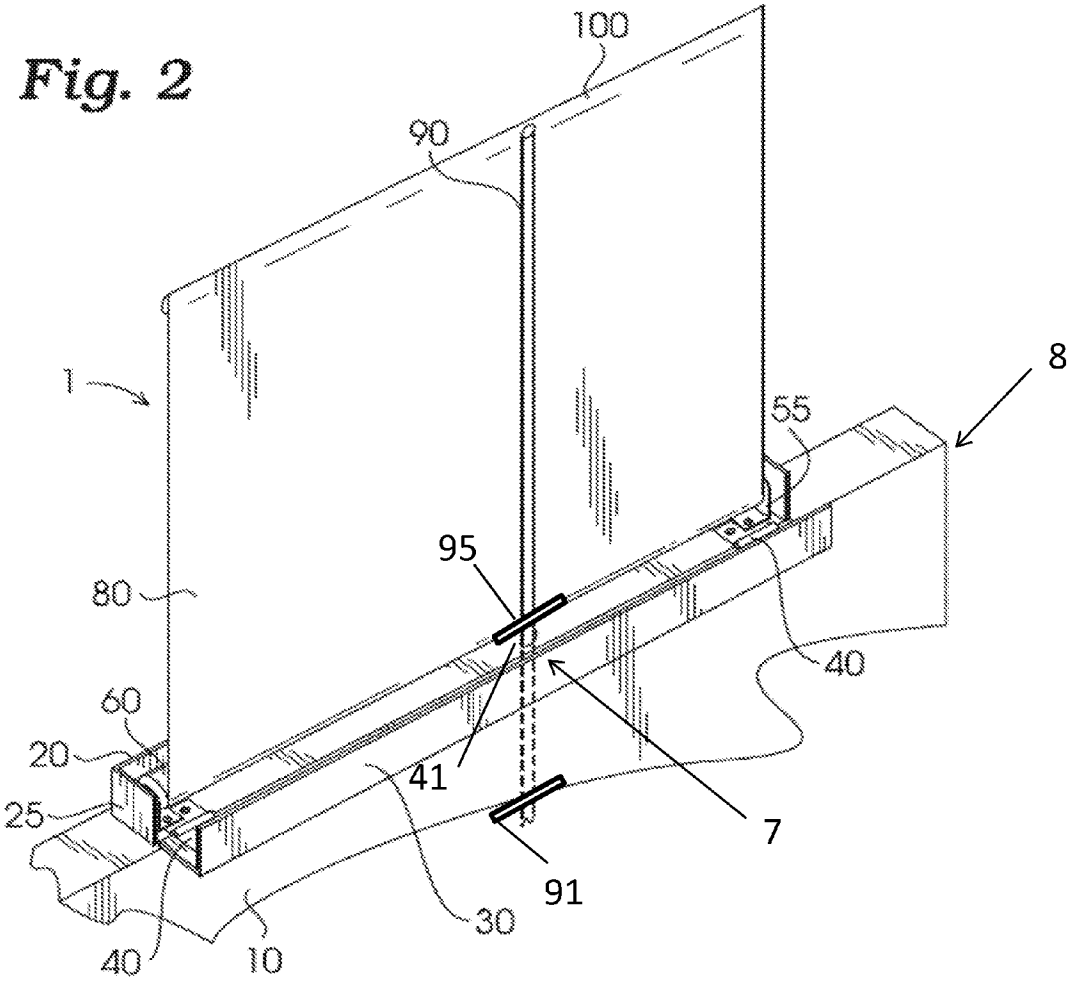
FIG. 2 is a rear perspective drawing of the mounting fixture with the first and second surfaces in the open position and the screen in the extended upward position with the extension member extended.
Figure 3:
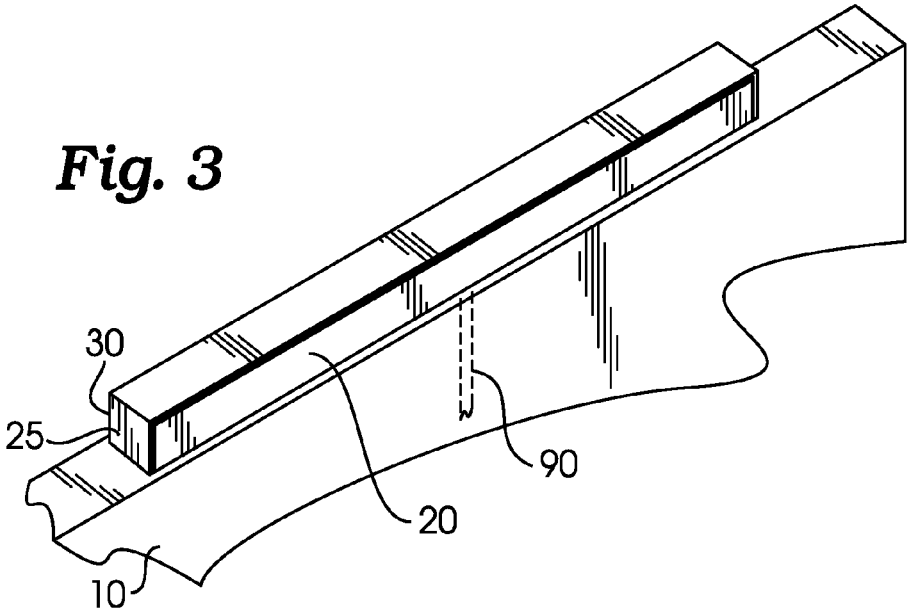
FIG. 3 is a front perspective drawing of the mounting fixture with the first and second surfaces in the closed position and the screen in the retracted downward position with the extension member retracted.
Figure 4:
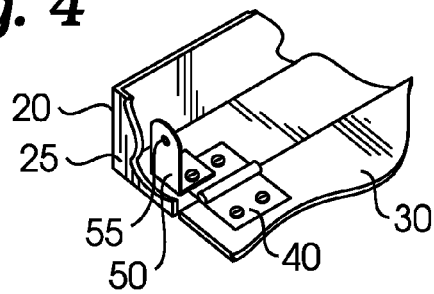
FIG. 4 is a perspective drawing of the construction of the mounting fixture with the first angle iron having attached a hinge and a mounting bracket.

The mounting fixture 1 of the present invention is shown in FIGS. 1, 2 and 3. It is mounted on the top 4 of a wall 10, such as is typical of office cubicle walls. The cubicle wall 10 typically has two side panels 6 in parallel alignment forming a space 8 between the panels. Such a structure typically absorbs sound. The fixture 1 has a first surface 20 and a second surface 30. As shown in FIG. 4, said surfaces 20 and 30 are movingly engaged by a connecting means such as at least one hinge, strap or spring 40. Preferably, the first and second surfaces 20 and 30 are engaged by at least two cabinet hinges. Cabinet hinges have the advantage of allowing the first and second surfaces to open to a 180 degree angle and no further. The first and second surfaces 20 and 30 may be made of any suitable rigid material such as iron or aluminum, rigid polymers or wood. The materials may be unfinished or painted or stained. Preferably aluminum angle of the dimensions 2 inches by 2 inches by ⅛ inch is used, however, curved, round or rectangular materials may be used.

Figure 5:
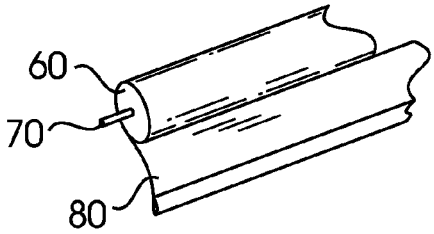
FIG. 5 is a perspective drawing of the roller with the screen.

As shown in FIG. 4, the first and second surfaces 20 and 30 are assembled by attaching two pieces of aluminum angle together in a parallel fashion using one or more cabinet hinge 40 using screws or other means of attaching (not shown). Further attached to the first surface are two brackets 50 which project up perpendicularly from the surface of the hinge 40. At least two brackets 50 are needed, one at each end of the mounting fixture 1, on first surface 20, to work in opposition to hold in place spring mounted roller 60, which is mounted between the two brackets 50. The spring mounted roller 60 has coiled around it a flexible screen material which forms the retractable screen 80. Brackets 50 are of a size sufficient to provide a surface and an opening 55 in which to insert and engage the tab 70 extending from the roller 60. The roller 60 with the screen 80 is shown in FIG. 5. The size of the surfaces 20 and 30 is such that the roller 60 nests inside with sufficient space to revolve freely when the screen 80 is extended. In modifying the roller 60, the lock (not shown) on the one side has to be removed so that there is constant tension on the shade so it will retract with the rod and not lock up when lowering. The spring loaded roller keeps tension on the screen which prevents the extended screen from being unstable or floppy. Optionally, end pieces 25 are affixed to the ends of surface 20 by such means as adhesive, preferably epoxy adhesive. The size of end pieces 25 are such that when surfaces 20 and 30 are in the closed position, the end pieces align with both 20 and 30 to give the appearance of a closed box (see FIG. 3).

Extension member 90 has a top end 92 and a bottom end 94 and is mounted through an opening 40 in the first surface 20 and attached to the screen 80 at or near the top 100 of the screen. The top 100 of the screen is made rigid, typically by a rigid reinforcing strip inserted into a sleeve at the top 100 of the screen. The extension member 90 can be any suitable rigid device such as a metal rod or a wooden dowel to hold the screen up in the extended position and does not have any hinges. Optionally, the extension member 90 can be a telescoping rod. When the mounting fixture 1 is attached to the top of a cubicle wall 10, the top of the wall 10 may be modified with a second opening 7, allowing the extension member 90 to extend downward. The opening 7 in the top of the wall 10 is aligned with the opening 40 in the first surface 20, so that the extension member 90 can travel downward through both openings. The extension member 90, when retracted downward is in the space 8 in the cubicle wall, between and enclosed by the two side panels of the cubicle wall and the top of the wall. Since the extension member 90 is attached at or near the top 100 of the screen, the extension member 90 cannot drop down into the cubicle wall 10 where it would be difficult to retrieve.

The extension member 90 can optionally have a stop device 91 at the bottom of the member 90, such as a cotter pin, clamp or a bolt, to prevent the extension member 90 from being accidentally pulled out of the wall. The extension member 90 can be extended and set at different heights by drilling openings in the extension member 90 and using the appropriate fastener 95 to fasten the extension member 90 at the desired height. The fastener 95 can be a clamp or bolt or cotter pin that fastens through the opening thereby holding the member 90 at the desired height. The fastener, when engaged, sits on the first surface, preventing the extension member 90 from sliding down.

The mounting fixture can be attached to the top of the cubicle wall using fasteners such as screws or bolts.

To use the screen, the second surface 30 is moved into the open position, revealing the screen 80. The extension member 90 which is attached to the top of the screen 100 is moved upward, thereby extending the screen 80 upward in the extended position. When the screen 80 is at the desired height, the fastener can be used to hold the screen 80 in place.

To retract the screen 80, the fastener is removed and the screen 80 and the extension member 90 are retracted downward until almost flush with the first surface 20. The second surface 30 is moved into the closed position and the screen 80 is enclosed in the mounting fixture 1. The roller 60, screen 80 and extension member 90 are all neatly stored and out of sight.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A fixture for mounting a roller with a retractable screen on a top of a cubicle wall wherein the fixture comprises:

a) a first surface, and b) a second surface, wherein the first surface and the second surface are movingly engaged to have an open position and a closed position;

wherein the first surface has an opening;

wherein in the closed position the first and second surfaces approximately enclose the roller with the retractable screen;

wherein the roller is a spring mounted roller which works to retract the screen;

wherein the roller is attached to the first surface with brackets;

wherein the screen has a rigid top;

wherein the screen has an extended upward position and a retracted downward position; and c) one extension member having a top end and a bottom end, wherein the top end is attached to the top of the screen;

wherein the bottom end of the extension member extends down through the opening in the first surface;

wherein the extension member is straight and rigid without hinges;

wherein when the extension member is in the extended position the screen is in the extended upward position;

wherein when the extension member is retracted, the screen is in the retracted downward position;

wherein the extension member has a fastener to hold the member in the extended position; and wherein the spring loaded roller keeps tension on the screen which prevents the extended screen from being unstable or floppy; wherein as the screen is retracted, the bottom end of the extension member is moved into an interior space of the cubicle wall.

2. The mounting fixture of claim 1, wherein the extension member has a stop device.

3. The mounting fixture of claim 1, wherein the first surface and the second surface are movingly engaged using at least one hinge.

4. The mounting fixture of claim 3, wherein the at least one hinge is a cabinet hinge.

5. The mounting fixture of claim 1, wherein attached to the first surface are end pieces.

6. The fixture of claim 1, wherein the fixture is mounted on the top of the cubicle wall.

7. A cubicle wall comprising a wall top and two parallel panels;

wherein on the wall top is a fixture for mounting a roller with a retractable screen wherein the fixture comprises:

a) a first surface, and b) a second surface, wherein the first surface and the second surface are movingly engaged to have an open position and a closed position;

wherein the first surface has an opening;

wherein in the closed position the first and second surfaces approximately enclose the roller with the retractable screen;

wherein the roller is a spring mounted roller to retract the screen;

wherein the roller is attached to the first surface with brackets;

wherein the screen has a rigid top;

wherein the screen has an extended upward position and a retracted downward position; and c) one extension member having a top end and a bottom end, wherein the top end is attached to the top of the screen;

wherein the bottom end of the extension member extends down through the opening in the first surface;

wherein the extension member is straight and rigid without hinges;

wherein when the extension member is in the extended position the screen is in the extended upward position;

wherein when the extension member is retracted, the screen is in the retracted downward position;

wherein the extension member has a fastener to hold the member in the extended position; and wherein the spring loaded roller keeps tension on the screen which prevents the extended screen from being unstable or floppy; wherein as the screen is retracted, the bottom end of the extension member is moved into an interior space of the cubicle wall.

8. The cubicle wall of claim 7, wherein the extension member has a stop device.

9. The cubicle wall of claim 8, wherein the first surface and the second surface are movingly engaged using at least one hinge.

10. The cubicle wall of claim 9, wherein the at least one hinge is a cabinet hinge.

11. The cubicle wall of claim 7, wherein the panels form the interior space between the panels.

12. A mounting fixture for mounting a roller with a retractable screen on the top of a cubicle wall wherein the fixture comprises a) a first surface, and b) a second surface, wherein the first surface and the second surface are movingly engaged to have an open position and a closed position;

wherein the first surface has an opening;

wherein in the closed position the first and second surfaces approximately enclose the roller with the retractable screen;

wherein the roller is a spring mounted roller to retract the screen;

wherein the roller is attached to the first surface with brackets;

wherein the screen has a rigid top;

wherein the screen has an extended upward position and a retracted downward position; and c) one extension member having a top end and a bottom end, wherein the top end is attached to the top of the screen;

wherein the bottom end of the extension member extends down through the opening in the first surface;

wherein the extension member is straight and rigid without hinges;

wherein when the extension member is in the extended position the screen is in the extended upward position;

wherein when the extension member is retracted, the screen is in the retracted downward position;

wherein the extension member has a fastener to hold the member in the extended position;

wherein the fixture is attached to the top of the cubicle wall;

wherein the top of the cubicle wall has a second opening which aligns with the opening in the first surface, wherein the extension member extends downward through the second opening and the opening in the first surface, into an interior space of the cubicle wall; and wherein the spring loaded roller keeps tension on the screen which prevents the extended screen from being unstable or floppy.

13. The fixture of claim 12, wherein the wall is formed by two panels.

14. The fixture of claim 13, wherein the panels are in parallel alignment and form the interior space between the panels and the top of the wall.

15. The fixture of claim 14, wherein when the extension member is retracted and the first and second surfaces are in the closed position, the screen, roller and extension member are stored out of sight.

16. The fixture of claim 12, wherein the first and second surfaces are movingly engaged by cabinet hinges.

* * * * *